United States Patent [19]

Takamatsu

[11] 4,009,505

[45] Mar. 1, 1977

[54] CARPET SECURING DEVICE

[75] Inventor: Ikuo Takamatsu, Uozu, Japan

[73] Assignee: Yoshida Kogyo Kabushiki Kaisha, Japan

[22] Filed: Jan. 22, 1976

[21] Appl. No.: 651,546

[30] Foreign Application Priority Data

Feb. 1, 1975 Japan ..... 50-15133[U]
Feb. 1, 1975 Japan ..... 50-15134[U]

[52] U.S. Cl. ..... 16/7; 24/205 R; 16/9

[51] Int. Cl.[2] ..... A47G 27/04

[58] Field of Search ..... 16/4, 5, 6, 7, 8, 9, 16/16; 24/205 R, 205.16 C, 205.16 R

[56] References Cited

UNITED STATES PATENTS

| | | | |
|---|---|---|---|
| 358,049 | 2/1887 | McCastline | 16/7 |
| 724,885 | 4/1903 | Kingston | 16/16 UX |
| 1,959,136 | 5/1934 | Miller | 16/16 UX |
| 2,496,910 | 2/1950 | Fridolph | 16/7 UX |
| 3,710,414 | 1/1973 | Fuller | 16/8 |

*Primary Examiner*—Andrew V. Kundrat
*Attorney, Agent, or Firm*—Bucknam and Archer

[57] ABSTRACT

There is disclosed an adapter and anchoring means combination for securing floor coverings into position on floors or the like. The adapter comprises a longitudinal strip for attachment to a reverse surface of the covering or carpet and a locking projection formed integrally with and extending along a longitudinal edge of the strip. The anchoring means is in the form of plinth or baseboard and has an elongate channel and a slit communicating coextensively with the channel. The locking projection protrudes from an edge of the carpet and is retained in locked relation to the channel when the adapter is attached to the carpet.

4 Claims, 6 Drawing Figures

CARPET SECURING DEVICE

BACKGROUND OF THE INVENTION

This invention relates to carpets and similar floor coverings and has particular reference to such coverings which are provided with means for securing the same into position on floors or the like.

When securing a carpet or a similar article to a floor, it has been a conventional practice to use tacks, snap buttons and other stoppers that are arranged at suitable intervals along the edges of the carpet. This method of securing carpets to the floor has the drawback that since the carpet is tacked in place at discontinual locations, it is susceptible to creases or puckers at such locations when attempting to keep the carpet taut. Furthermore, the tacked areas of the carpet are prone to get shrunk when laundered, or get swollen or slackened when brushed, resulting in unsightly, deformed surface appearance.

An advanced method is also known in which a plinth or baseboard is utilized, in place of discretely arranged tacks, for holding a marginal edge of a carpet in its continuity down on the floor, so that local deformation of the carpet may be eliminated. However, this is a rather time-consuming and tedious operation, and what is more, the plinth has to be removed each time the carpet is laundered.

SUMMARY OF THE INVENTION

With the foregoing difficulties of the prior-art carpet assembling in view, it is a primary object of the present invention to provide a carpet adapter which will enable a carpet or the like to be installed on the floor with utmost ease and without presenting any substantial surface deformation.

Another object of the invention is to provide a carpet adapter which will permit a carpet to be readily removed from the floor when desired for laundering or replacement.

According to this invention, there is provided the combination with an anchoring means of an adapter for carpets or the like. The adapter comprises a longitudinal strip adapter for attachment to a reverse surface of the carpet and a locking projection formed integral with and along a longitudinal edge of the strip. The anchoring means has an elongate channel and a slit communicating coextensively with the channel. The locking projection protrudes from an edge of the carpet and is retained in locked relation to the channel when the adapter is attached to the carpet.

The invention may be better understood from the following description of certain preferred embodiments taken in connection with the accompanying drawings in which like reference characters refer to like parts.

DETAILED DESCRIPTION OF THE PREFERRED EMBODIMENTS

Figure 1:
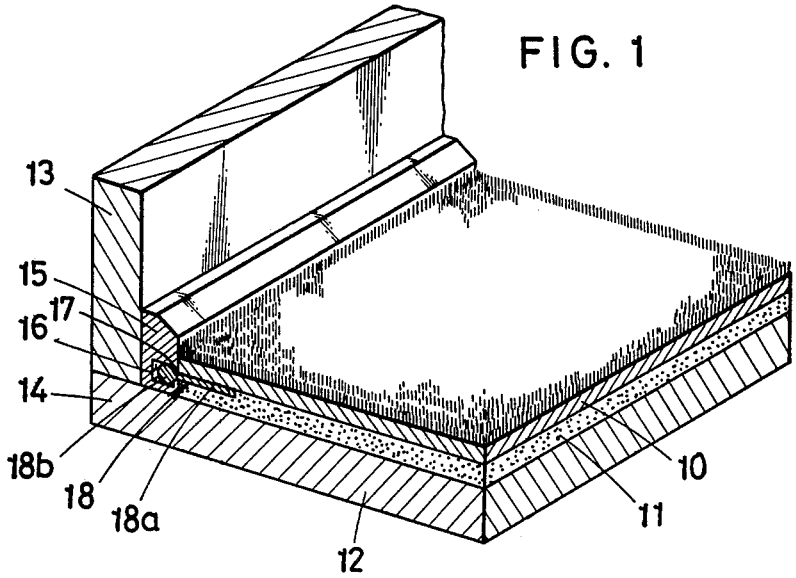
FIG. 1 is a fragmentary perspective view of a carpet installed in accordance with a preferred embodiment of the invention.

Referring now to the drawings and FIG. 1 in particular, there is shown a carpet 10 which may be of any known material and construction and which is laid over a sheet or under-cushion 11 which is in turn laid over a floor 12 in a building. An end wall 13 extends vertically from the floor 12 and forms therewith a corner 14. At the corner 14 is provided an anchoring means 15 in the form of a plinth or baseboard which extends horizontally along the length of the end wall 13 and which has an elongate channel 16 formed therein and extending the full length of the means 15. The anchoring means 15 is further provided with a longitudinal slit 17 opening horizontally through one vertical wall of the anchoring means 15 and communicating coextensively with the channel 16.

The carpet 10 is provided with a carpet adapter 18 embodying the invention, which adapter 18 comprises a longitudinal strip or tape-like portion **18*a* adapted to be secured to a reverse surface of the carpet 10 adjacent to an edge thereof, and a locking projection 18*b* formed integral with and along a longitudinal edge of the strip 18*a*, the strip 18*a* being coextensive with the edge of the carpet 10 to which the adapter 18 is to be secured. The locking projection 18*b* may be preferably round in cross-section as illustrated or may be of any other sectional configuration suitable for engagement in the aforementioned channel 16 of the anchoring means 15. When installing the carpet 10 on the floor 12, the locking projection 18*b* is inserted from either end into and through the channel 16 of the anchoring means 15 with the strip 18*a* guided through the slit 17 which is wide enough to receive the strip 18*a* but narrow enough to retain the locking projection 18*b* in locked relation to the channel 16. The locking projection 18*b* protrudes from the edge of the carpet 10 in parallel relation thereto such that when the carpet 10 is secured into position on the floor 12, an extremity of the edge of the carpet 10 can be held in closely abutting relation to the vertical wall of the anchoring means 15** as shown.

Figure 2:
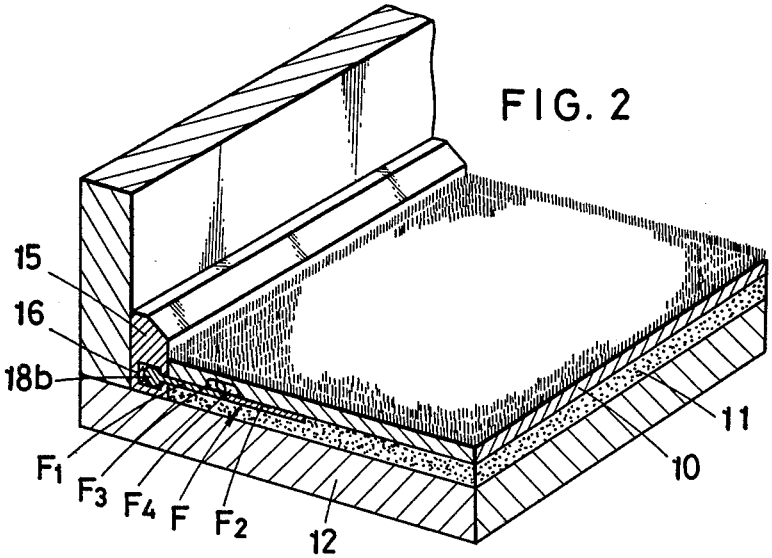
FIG. 2 is a view similar to FIG. 1 but showing another preferred embodiment.
Figure 5:
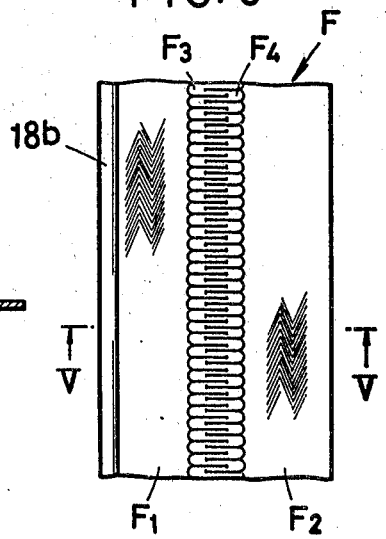
FIG. 5 is a fragmentary plan view of a sliding clasp fastener employed in accordance with the invention.
Figure 6:
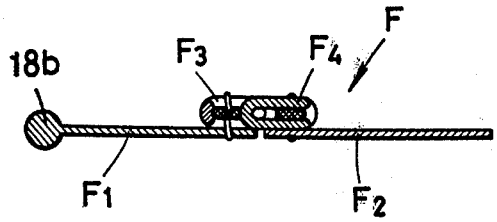
FIG. 6 is a transverse cross-sectional view taken along the line V—V of FIG. 5.

There is shown in FIG. 2 a modification of the adapter 18 which comprises a sliding clasp fastener F which as better shown in FIGS. 5 and 6 comprises a pair of opposed stringers $F_1$, $F_2$ having rows of interlocking fastener elements $F_3$, $F_4$ along respective inner longitudinal edges which are taken into and out of mutual engagement by a slider (not shown), one stringer $F_1$ having a locking projection **18*b* secured to its outer longitudinal edge and the other stringer $F_2$ being adhesively secured to the reverse surface of the carpet 10. The advantage of this modification is that the carpet 10 can be readily removed from the floor 12 by disengaging the fastener stringers $F_1$ and $F_2$ from each other in the usual manner without having to remove the locking projection 18*b* from the anchoring means 15.**

Figure 3:
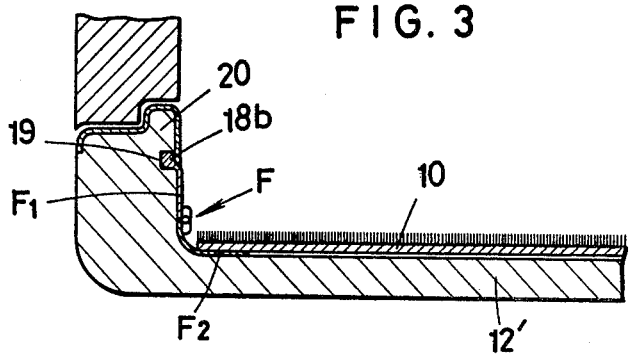
FIG. 3 is a sectional view of a carpet installed in accordance with a further preferred embodiment.

FIG. 3 shows the carpet 10 as installed on a floor 12' of an automobile or the like, in which instance there is provided a recess 19 in a rising portion 20 of the floor for receiving the locking projection 18*b* of the adapter 18 attached to the carpet 10.

Figure 4:
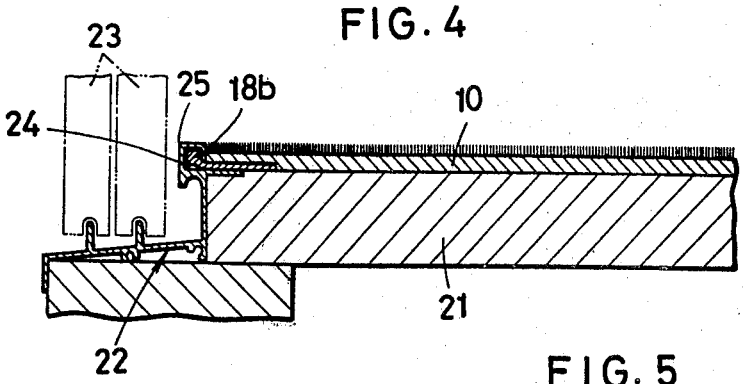
FIG. 4 is a sectional view of a carpet installed in accordance with still another preferred embodiment.

FIG. 4 shows the carpet 10 as installed on a corridor 21 connected to a frame sill 22 for sliding doors 23, the frame sill 22 having a longitudinal channel 24 formed in the top of a rising portion 25 for removably receiving the locking projection 18*b* of the adapter 18 attached to the carpet 10.

What is claimed is:

1. The combination with an anchoring means of an adapter for carpets and the like, said adapter comprising a longitudinal strip attached to a reverse surface of the carpet and a locking projection formed integral with and along a longitudinal edge of said strip, said anchoring means having an elongate channel and a slit communicating coextensively with said channel, and said locking projection protruding from an edge of the carpet, and retained in locked relation to said channel when said adapter is attached to the carpet, said adapter further comprising a sliding clasp fastener having a pair of opposed interlockable stringers, one of said stringers bearing said locking projection and the other stringer being attached to said reverse surface of the carpet.

2. The combination as claimed in claim 1 wherein said anchoring means is a plinth having said channel and said slit.

3. The combination as claimed in claim 1 wherein said anchoring means is a rising portion of an automobile body floor having said channel and said slit.

4. The combination as claimed in claim 1 wherein said anchoring means is a frame sill having said channel and said slit.

* * * * *